US005645439A

United States Patent [19]

Nugent, Jr. et al.

[11] Patent Number: 5,645,439

[45] Date of Patent: Jul. 8, 1997

[54] AUTOMATIC POWER LINE DISCONNECT APPARATUS

[75] Inventors: Thomas H. Nugent, Jr., Port Jefferson Station; Ernest A. Kussmaul, Sayville, both of N.Y.

[73] Assignee: Kussmaul Electronics Company, Inc., West Sayville, N.Y.

[21] Appl. No.: 585,841

[22] Filed: Jan. 16, 1996

[51] Int. Cl.[6] ..... H01R 13/62

[52] U.S. Cl. ..... 439/159; 439/923

[58] Field of Search ..... 439/152, 153, 439/155, 158, 159, 160, 923, 39

[56] References Cited

U.S. PATENT DOCUMENTS

| | | | |
|---|---|---|---|
| 3,431,428 | 3/1969 | Van Valer | 439/153 |
| 3,475,715 | 10/1969 | Venaleck | 439/159 |
| 4,118,690 | 10/1978 | Paynton | 439/159 |
| 4,157,855 | 6/1979 | Chan | 439/155 |
| 5,266,040 | 11/1993 | Merrill et al. | 439/159 |

*Primary Examiner*—David L. Pirlot
*Assistant Examiner*—Brian J. Biggi
*Attorney, Agent, or Firm*—Charles E. Baxley, Esq.

[57] ABSTRACT

An apparatus includes a connector which, in use, is connected to a shore cable. The shore cable provides power to a vehicle. A connection in the apparatus to the vehicle's starting circuit actuates an ejector mechanism when the vehicle's engine is started. The ejector mechanism ejects the shore cable from the apparatus and a switch interrupts the current prior to the completion of the ejection action, thereby preventing arcing at the connector and assuring long contact life.

5 Claims, 6 Drawing Sheets

AUTOMATIC POWER LINE DISCONNECT APPARATUS

BACKGROUND OF INVENTION

The present invention relates generally to electrical connectors and more particularly to an automatic power line disconnect apparatus which is capable of automatically disconnecting a power line which is connected to a vehicle when the vehicle's engine is started.

Emergency vehicles such as fire trucks and ambulances, recreational vehicles and power boats typically utilize power lines which are connected to stationary power sources for supplying electrical power for starting engines and other devices. There is a continuing need for an apparatus which is capable of automatically disconnecting the power line when the vehicle's engine is started in order to prevent broken power lines. There is also a need for an apparatus for disconnecting power lines in which the current flow is interrupted prior to disconnection in order to prevent arcing.

OBJECTS AND SUMMARY OF INVENTION

It is an object of the present invention to provide an automatic power line disconnect apparatus which can automatically disconnect a vehicle's power line when the vehicle's engine is started.

Another object of the present invention is to provide an automatic power line disconnect apparatus which incorporates a completely sealed unit to prevent contamination.

Another object of the present invention is to provide an automatic power line disconnect apparatus which is capable of opening the power circuit prior to disconnection of the power line to eliminate arcing at the contacts.

Another object of the present invention is to provide an automatic power line disconnect apparatus in which an interrupter switch closes after the power line connector makes contact and opens before the power line connector is disconnected.

Yet another object of the present invention is to provide an automatic power line disconnect apparatus which comprises a relatively small number of relatively simple component parts resulting in reliable long term operation.

The foregoing and other objects and advantages of the present invention will appear more clearly hereinafter.

In accordance with the present invention there is provided an automatic power line disconnect apparatus which includes a sealed housing on which an electrical connector is mounted. During use, the electrical connector mates with an electrical connector which is part of a shore cable which is typically connected to an engine starting circuit on an emergency vehicle such as a fire truck or ambulance, a recreational vehicle or on a power boat. Voltage which is applied to the starter when the engine is cranked is applied to a solenoid in the automatic power line disconnect apparatus. The solenoid operates an ejector mechanism which is mounted in the housing.

The ejector mechanism ejects the shore cable from the apparatus and a switch which is mounted in the housing interrupts the current prior to the completion of the ejection action, thereby preventing arcing at the connector contacts and assuring long contact life.

BRIEF DESCRIPTION OF THE DRAWINGS

Other important objects and advantages of the present invention will be apparent from the following detailed description, taken in conjunction with accompanying drawings in which.

DETAILED DESCRIPTION OF THE INVENTION

Figure 1:
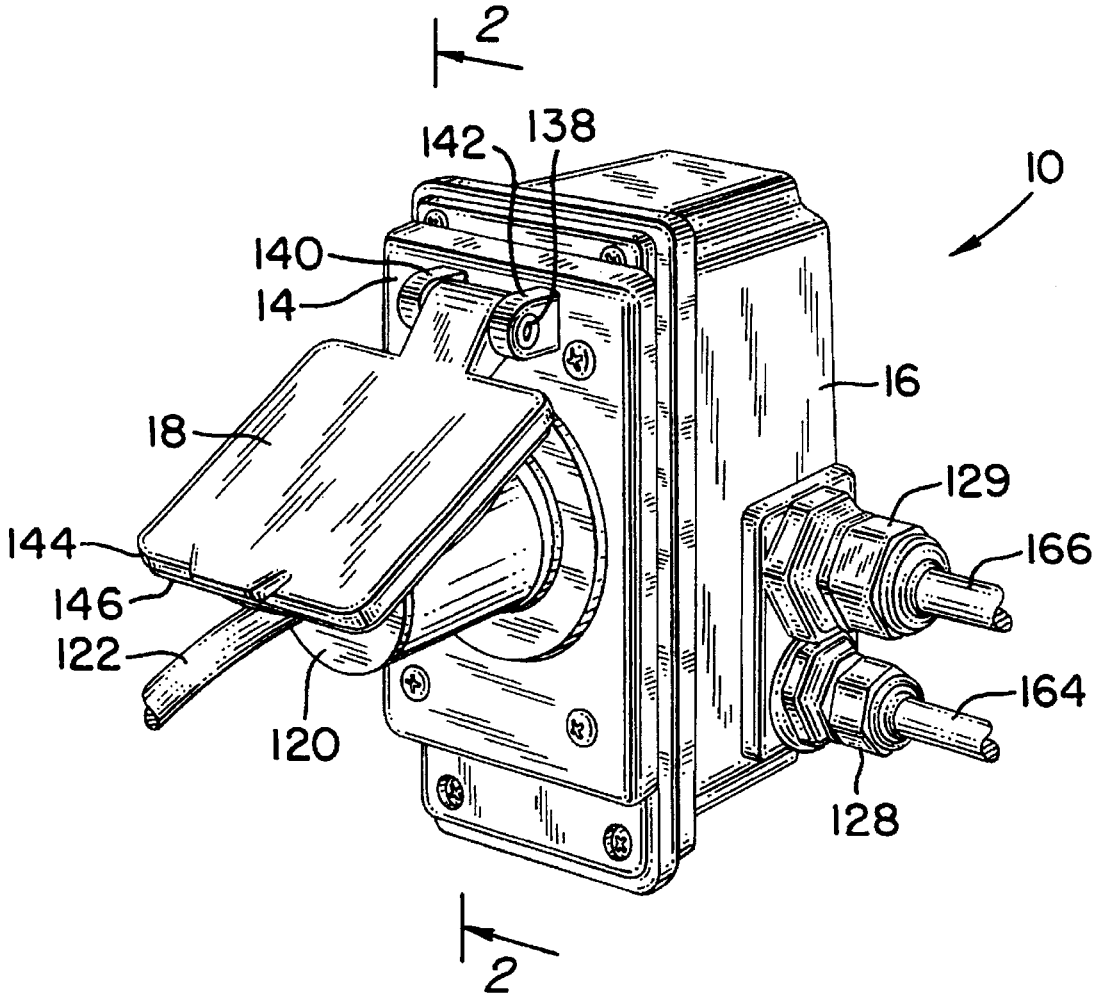
FIG. 1 is a perspective view of an automatic power line disconnect apparatus, made in accordance with the present invention, with the apparatus shown in use connected to a shore cable.

With reference to the drawings, wherein like reference numbers designate like or corresponding parts throughout, there is shown in FIGS. 1–12 an automatic power line disconnect apparatus 10, made in accordance with the present invention, which includes a base member 12, a front cover 14 and a male connector 20. Male connector 20 includes a circular mounting plate 22 which is secured on base member 12 by screws 24, 26, 28. Male connector 20 also includes a central aperture 30 which cooperates with ejecting pin 32 in a manner which will be presently described.

Figure 4:
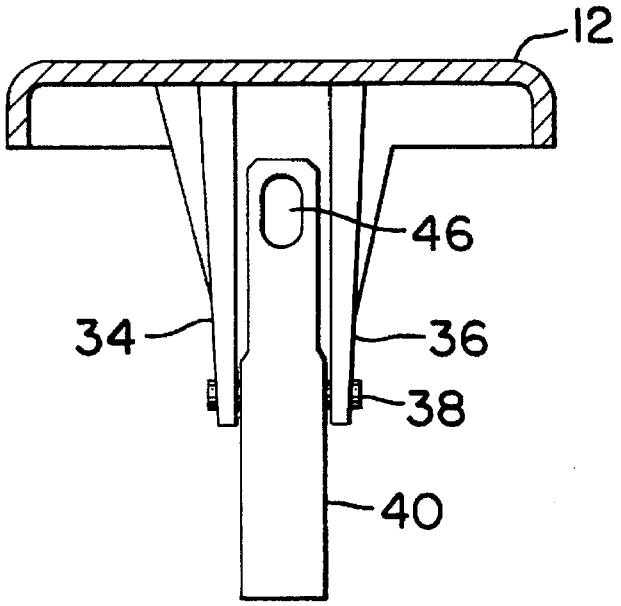
FIG. 4 is a fragmentary cross-sectional view taken along line 4—4 of FIG. 2.

Base member 12 includes a pair of integrally formed spaced apart supports 34, 36 which are best shown in FIG. 4. As is shown in FIG. 4, supports 34, 36 and pivot pin 38 provide a pivotal support for trigger member 40. Trigger member 40 includes an upper portion 42 which has a curved portion 44 in which an elongated hole 46 is formed and also includes a lower portion 48 which has a step or detent portion 50.

Figure 5:
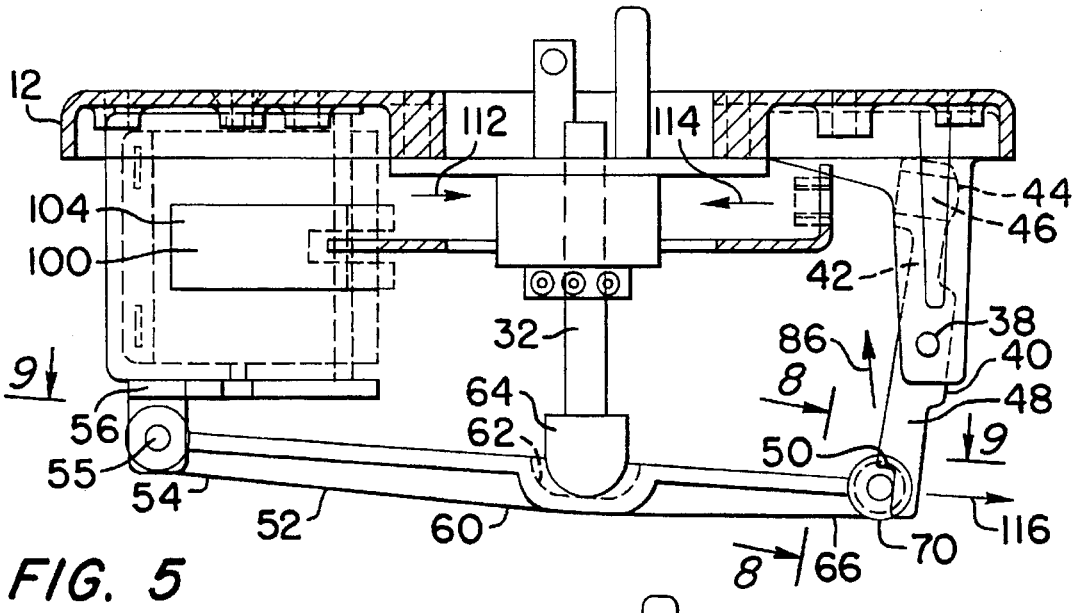
FIG. 5 is a simplified cross-sectional view similar to FIG. 2, showing selected components of the apparatus and showing the ejecting pin in the fully retracted position.
Figure 6:
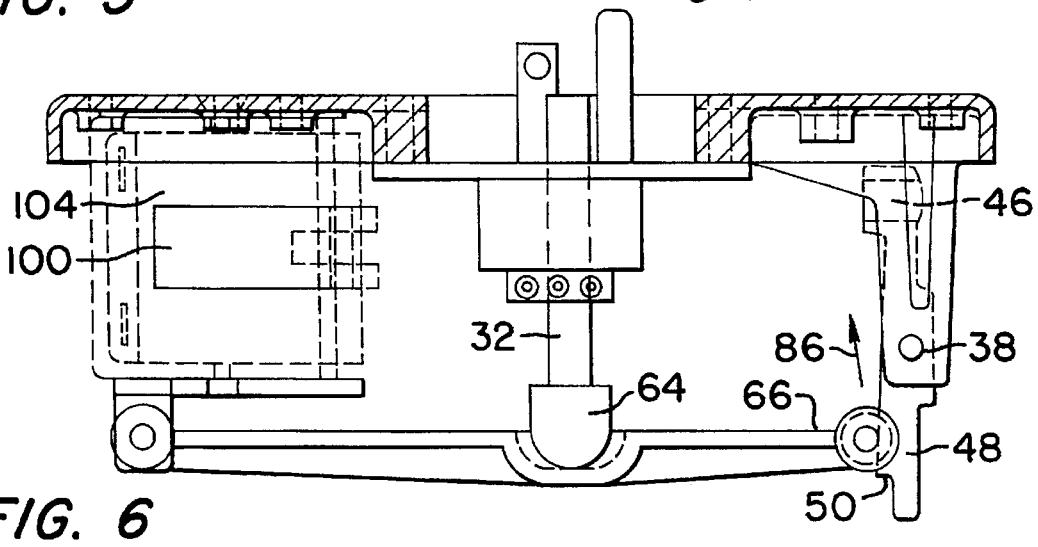
FIG. 6 is a simplified cross-sectional view similar to FIG. 5, showing the ejecting pin partially extended.

Ejecting bracket 52 has a first portion 54 which is pivotally mounted on a support bracket 56 by means of pin 55. Support bracket 56 is mounted on solenoid 104 which in turn is mounted on the base member 12. An intermediate portion 60 of ejecting bracket 52 includes an elongated cup-shaped depression 62 which cooperates with a spherical end portion 64 which is formed on ejecting pin 32. Ejecting bracket 52 has a second end 66 which includes a pair of oppositely directed post portions 68, 70 and a central portion 72 which engages the detent 50 in the trigger member 40, as is best shown in FIGS. 5, 8 and 9.

A pair of tension springs 74, 76 are provided, each of which has a first end 78 which hooks onto one of the posts 68, 70 and an upper end 80 which is attached to the base member 12 by means of a screw 82, 84. The tension springs 74, 76 provide continuing upwardly directed forces on the second end 66 of the ejecting bracket 52 as is indicated by the arrows 86, in FIGS. 5, 6, 7 and 8.

Figure 8:
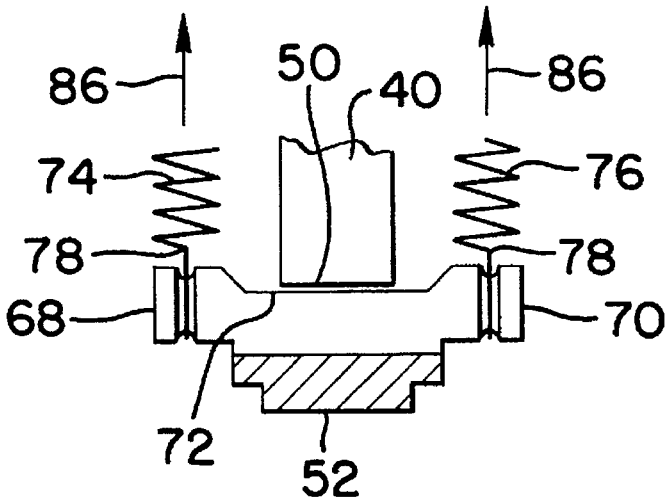
FIG. 8 is a fragmentary cross-sectional view taken along line 8—8 in FIG. 5.
Figure 9:
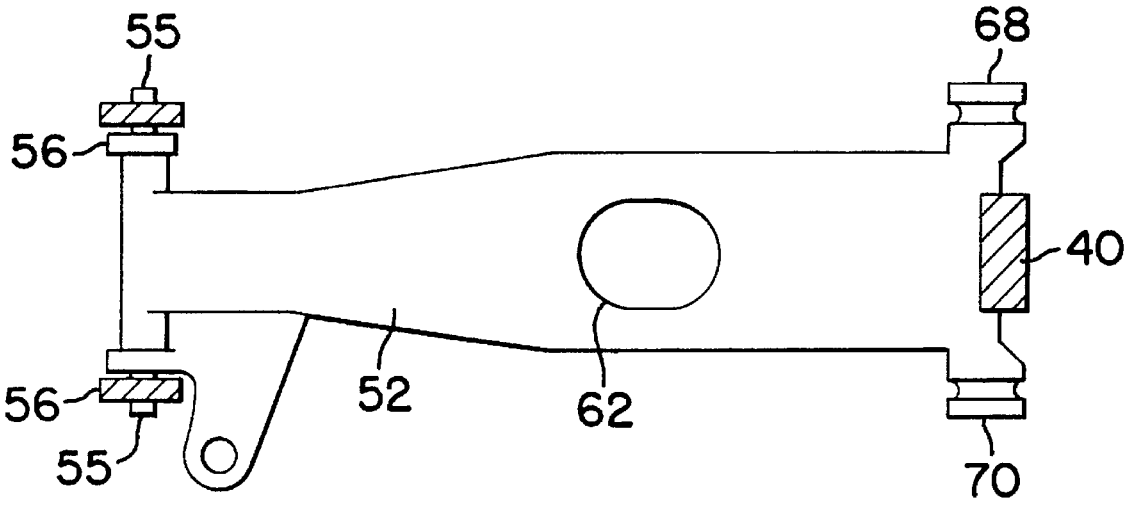
FIG. 9 is a fragmentary cross-sectional view taken along line 9—9 in FIG. 5.
Figure 10:
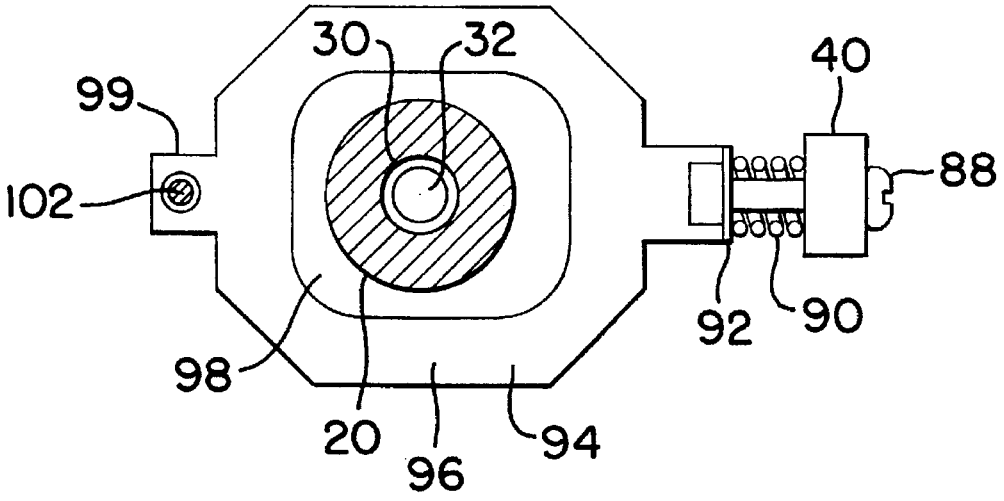
FIG. 10 is a fragmentary cross-sectional view taken along line 10—10 in FIG. 7.
Figure 11:
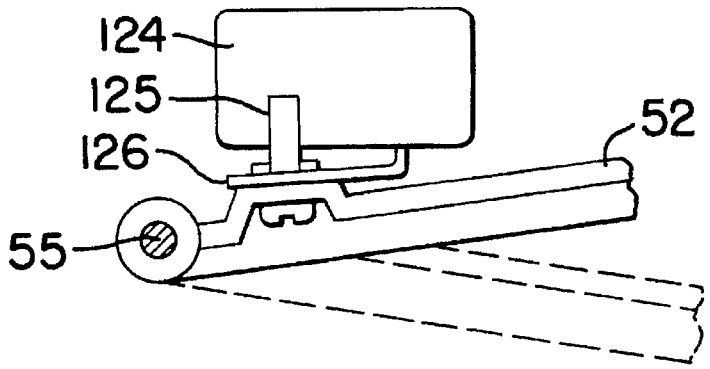
FIG. 11 is a fragmentary view showing a portion of FIG. 2 drawn to an enlarged scale.

As is shown in FIG. 8, the use of two tension springs 74, 76 provides a convenient way of achieving a relatively high level of force which is balanced, thereby preventing twisting or jamming of the ejecting bracket 52.

Figure 2:
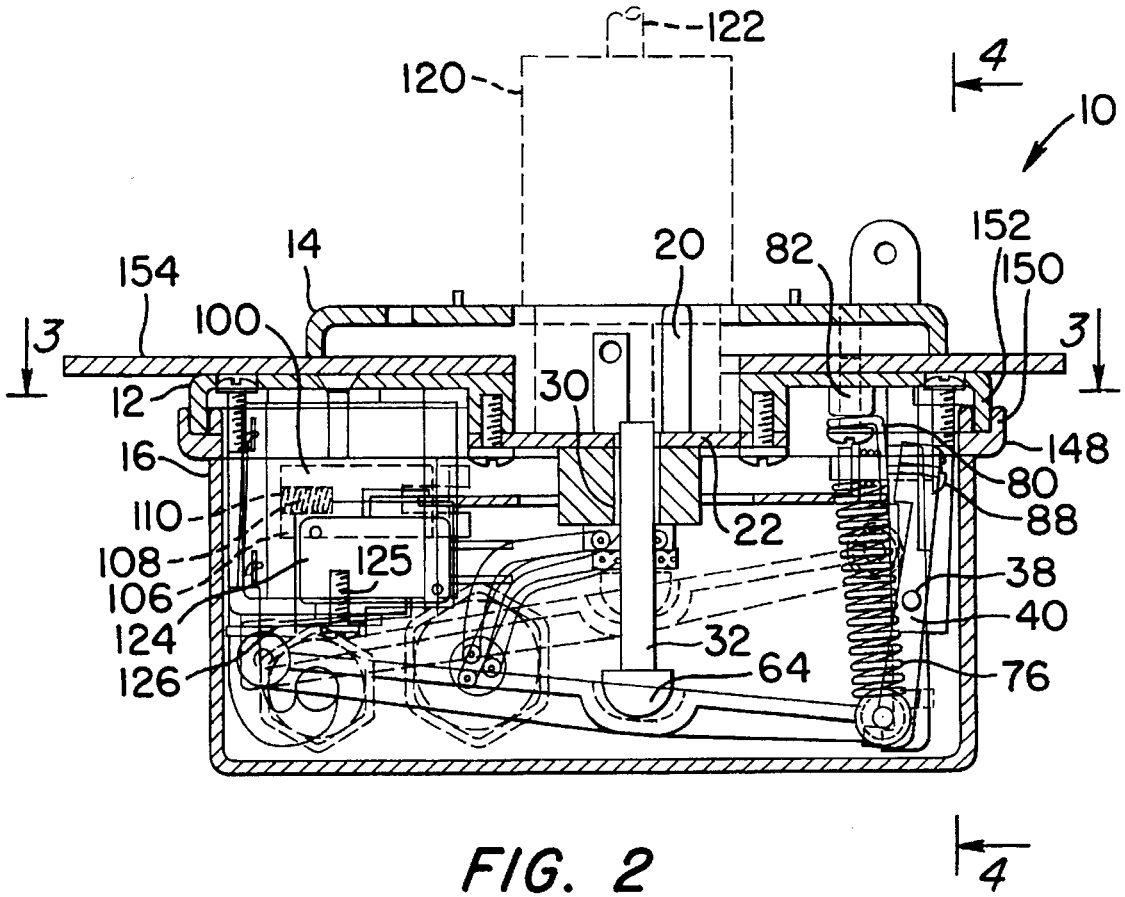
FIG. 2 is a cross-sectional view taken along line 2—2 of FIG. 1.
Figure 3:
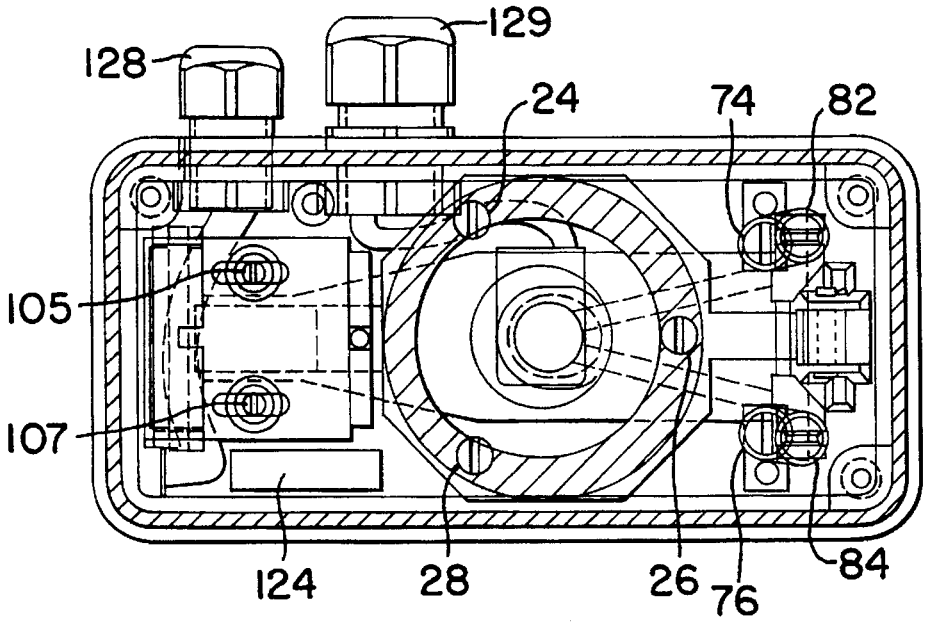
FIG. 3 is a cross-sectional view taken along line 3—3 of FIG. 2.
Figure 7:
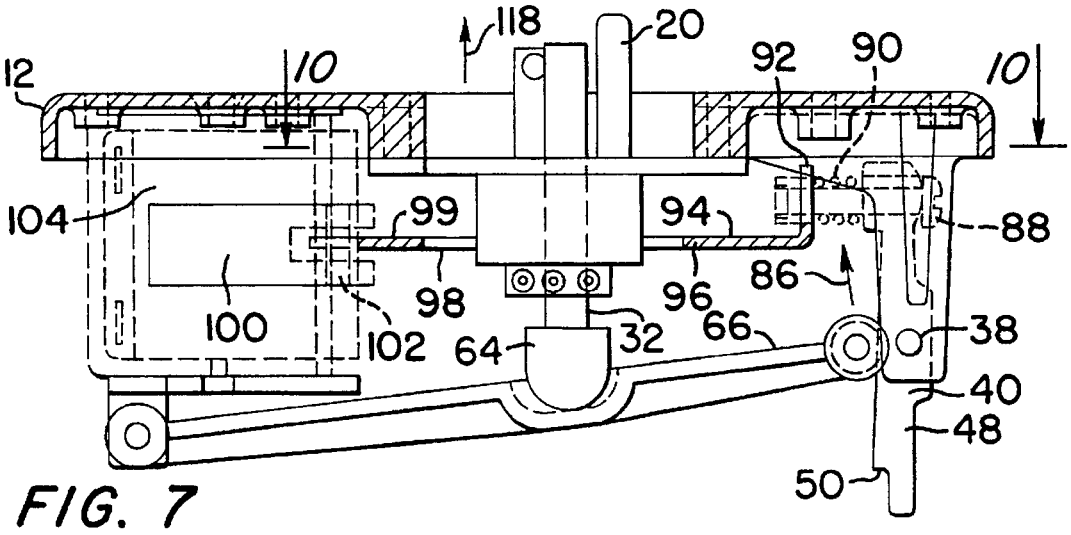
FIG. 7 is a simplified cross-sectional view similar to FIG. 5, showing the ejecting pin fully extended.

A screw 88 passes through elongated hole 46 in trigger member 40 and passes through a compression spring 90 and is threaded into a bracket 92 which is formed on pull-down plate 94, as is best shown in FIGS. 2 and 7. The elongated hole 46 accommodates the motion of the trigger member 40, as is shown in FIGS. 2 and 5–7.

Pull-down plate 94 has a central portion 96 which includes an aperture 98 through which the male connector 20 passes and an end portion 99 which is connected to a solenoid plunger shaft 100 by means of a pin 102, as is shown in FIG. 7. The solenoid plunger shaft 100 acts as the armature of the solenoid 104 which is mounted on the base member 12 by fasteners 105 and 107. End 106 of the solenoid plunger shaft 100 includes an aperture 108 which contains a spring 110 which normally urges the solenoid plunger shaft 100 in the direction shown by the arrow 112 in FIG. 5.

Energization of the solenoid 104 overcomes the spring 110 and causes the pull-down plate 94 to move in the direction shown by the arrow 114 in FIG. 5, and pulls on the screw 88. This causes the lower portion 48 of the trigger member 40 to swing outwardly in the direction shown by the arrow 116 in FIG. 5 and allows the tension springs 74, 76 to pull the ejecting bracket 52 upwardly, thereby forcing the ejecting pin 32 upwardly in the direction shown by the arrow 118 and ejecting the connector 120 which is part of the shore cable 122 and which is engaged on the male connector 20.

The shore cable 122 is typically connected via the apparatus 10 to a battery charger or other device on the vehicle which requires alternating current power. Starting of the engine causes voltage to be applied to the solenoid 104 to actuate solenoid plunger shaft 100 and, as described above, pull on screw so that the lower portion 48 of trigger member 40 swings outwardly, away from the ejecting bracket 52, allowing tension springs 74, 76 to pull the ejecting bracket 52 upwardly, forcing ejecting pin 32 upwardly and ejecting connector 120 from the apparatus 10.

A switch such as a microswitch 124 is mounted in housing 16 as is shown in FIG. 2. Operation of microswitch 124 is controlled by the position of the ejecting bracket 52 and when the shore cable 122 is connected, the microswitch 124 is closed and current flows through the microswitch 124 into the vehicle through shore cable 122.

When the solenoid 104 is energized, as described above, the ejecting bracket 52 starts to move in an upward direction. The ejecting bracket 52 is connected to the microswitch actuating arm 126 via screw 125 and the upward motion of the ejecting bracket 52 causes microswitch 124 to open and interrupt the current to the male connector 2*o*. The operation of microswitch 124 may be adjusted by rotating screw 125 which is carried by the ejecting bracket 52 and which is connected to microswitch actuating arm 126 and by adjustment of screw 88 to ensure that the current to the male connector 20 is interrupted prior to the ejection of the connector 120, thereby preventing unwanted arcing at the connector contacts when the connector 120 is ejected. It has been found that interrupting the current when the ejecting bracket 52 is approximately mid-way in the ejection cycle provides a satisfactory result. This mid-way position generally corresponds to a position of ejecting bracket 52 which is approximately mid-way between the lower position, shown in solid lines in FIG. 2, and the upper position, shown in broken lines in FIG. 2.

When the connector 120, which is typically part of a shore cable 122, which connects an emergency vehicle, a vessel or a recreational vehicle to a source of power, is again inserted in the apparatus 10 and connected to the male connector 20, the connector 120 forces the ejecting pin 32 in a downward direction which is opposite to the direction shown by the arrow 118 in FIG. 7. The downward motion of the ejecting pin 32 forces the ejecting bracket 52 downward and the end 66 of the ejecting bracket 52 again engages the detent 50 in the trigger member 40 and the apparatus 10 is ready for another operating cycle. The downward motion of the ejecting bracket 52 causes microswitch 124 to close and turn on current to the male connector 20.

The automatic power line disconnect apparatus 10 thus serves as a power input receptacle for the vehicle or vessel. Alternating current power comes from a source of power on the shore via a cable 122 and a connector 120, passes through the male connector 20 and supplies power to the vehicle or vessel. When the engine on the vehicle or vessel is started, the solenoid 104 is energized to operate the ejecting bracket 52 and the connector 120 is ejected from the apparatus 10.

Figure 12:
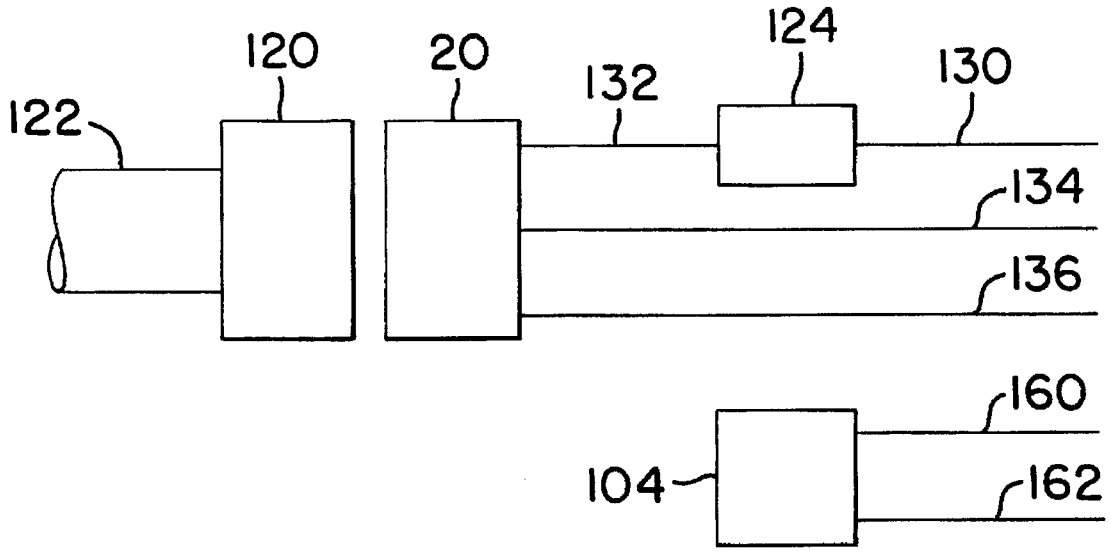
FIG. 12 is an electrical block diagram of the apparatus of FIG. 1.

As is shown in FIG. 12, the microswitch 124 is connected to the connector 20 via the lead 132. Leads 130, 134 and 136 are connected to the alternating current power loads on the vehicle. Lead 134 is a return and lead 136 is a ground. Solenoid 104 is connected to the starting circuit of the vehicle via leads 160, 162. Connector 120 is connected to the shore cable 122. Leads 160, 162 from the solenoid 104 pass through the housing 16 via the sealed strain relief fitting 128 and are contained in cable 164, as shown in FIG. 1. Leads 130, 134, 136 pass through the housing 16 15 via the strain relief fitting 129 and are contained in cable 166 as shown in FIG. 1.

As is shown in FIG. 1, the apparatus 10 includes a hinged cover 18 which is mounted on a pin 138 which is supported by a pair of brackets 140, 142 which are formed on the front cover 14. The edge 144 of the hinged cover 18 may include an elastomer seal 146 in order to provide environmental protection for the male connector 20 when the apparatus 10 is not in use. The upper edge 148 of the housing 16 forms a groove 150 into which the edge 152 of the base member 12 fits, thereby providing a seal for the housing 16.

The apparatus 10 may be mounted on a plate 154, as is shown in FIG. 2.

The foregoing specific embodiment of the present invention as set forth in the specification herein, is for illustrative purposes only. Various deviations and modifications may be made within the spirit and scope of this invention, without departing from the main theme thereof.

We claim:

1. An automatic power line disconnect apparatus for disconnection of an external cable connected to said apparatus comprising:

a housing means;

electrical connector means mounted in said housing for connection of said external cable;

electrical sensor means for sensing increased current flow through said connector;

ejector means for ejection of said external cable responsive to said electrical sensor means sensing increased current flow through said connector with said ejector means comprising:

elongated ejector bracket means for ejection of said external cable from said connector, with said ejector bracket means having a first end and a second end with said first end pivotally mounted in said housing;

trigger means having a first end and a second end and an intermediate portion, with said intermediate portion pivotally mounted in said housing, with said first end of sid trigger means comprising detent means removably engaging said first end of said ejector bracket means, with said second end of said trigger means connected to said electrical sensor means, with said electrical sensor means capable of actuating said trigger means to disengage said detent means from said ejector bracket means to allow said ejector bracket means to eject said external cable from said connector means; and spring means disposed in said housing and urging said ejector bracket means to eject said external cable when said ejector bracket means is disengaged from said trigger means.

2. An automatic power line disconnect apparatus according to claim 1, in which said spring means comprises a pair of tension springs.

3. An automatic power line disconnect apparatus according to claim 2, in which each of said tension springs has a first end connected to said ejector bracket means and a second end connected to said housing.

4. An automatic power line disconnect apparatus according to claim 1, further comprising adjustment screw means connecting said trigger means and said solenoid means.

5. An automatic power line disconnect apparatus according to claim 4, in which said adjustment screw means further comprises compression spring means.

* * * * *